US007131449B2

(12) United States Patent
Kagami et al.

(10) Patent No.: US 7,131,449 B2
(45) Date of Patent: Nov. 7, 2006

(54) WIG

(75) Inventors: Nagatoshi Kagami, Bangkok (TH); Mayumi Toba, Tokyo (JP); Hitoshi Akatsuka, Bangkok (TH); Hiroji Ishitaka, Tokyo (JP)

(73) Assignee: Aderans Co., Ltd., Tokyo (JP)

( * ) Notice: Subject to any disclaimer, the term of this patent is extended or adjusted under 35 U.S.C. 154(b) by 0 days.

(21) Appl. No.: 11/043,150

(22) Filed: Jan. 27, 2005

(65) Prior Publication Data

US 2006/0162734 A1 Jul. 27, 2006

(51) Int. Cl.
*A41G 3/00* (2006.01)
*A41G 5/00* (2006.01)

(52) U.S. Cl. ..... 132/201

(58) Field of Classification Search ..... 132/201, 132/53–56; 156/297, 299, 329, 289, 278
See application file for complete search history.

(56) References Cited

U.S. PATENT DOCUMENTS

| | | | | |
|---|---|---|---|---|
| 2,602,460 | A * | 7/1952 | Hull | 132/53 |
| 3,980,092 | A * | 9/1976 | Garufi | 132/53 |
| 4,205,693 | A * | 6/1980 | Mallouf | 132/53 |
| 4,799,502 | A * | 1/1989 | Kobayashi et al. | 132/53 |
| 6,689,931 | B1 | 2/2004 | Etheredge, III | |
| 6,691,714 | B1 | 2/2004 | Yaguchi et al. | |

FOREIGN PATENT DOCUMENTS

| | | |
|---|---|---|
| EP | 0 152 220 | 1/1989 |
| JP | 62-198223 | 12/1987 |
| JP | 2-78522 | 6/1990 |
| JP | 03-076804 | 4/1991 |
| JP | 5-27456 | 7/1993 |
| JP | 3101361 | 2/2004 |
| JP | 2004353127 A * | 12/2004 |

* cited by examiner

*Primary Examiner*—John J. Wilson
*Assistant Examiner*—Robyn Doan
(74) *Attorney, Agent, or Firm*—Wenderoth, Lind & Ponack, L.L.P.

(57) ABSTRACT

A wig is fabricated by: a masking sheet, having a great number of openings around 10 mm in diameter formed therein, being applied to a side of a wig base which is to face the scalp of a wearer; a silicone adhesive agent being applied to the wig base through the openings; one end of a tablet formed of a silicone substance, which can be placed within the opening, being adhered to the silicone adhesive agent, and further, a silicone adhesive agent being applied to a surface of the tablet and dried; following which the masking sheet is removed, thereby providing silicone protrusions fixed to the side of the wig base which is to face the scalp of the wearer.

20 Claims, 3 Drawing Sheets

WIG

BACKGROUND OF THE INVENTION

1. Field of the Invention

The present invention relates to a wig, and more particularly relates to a full or a partial wig, with hair fibers implanted, which has protrusions formed of a silicone substance on a side facing the scalp of a wearer.

2. Description of the Related Art

Wigs are generally used for hiding bald portions on a human scalp or portions thereof where hair growth is thinning, by covering these portions. Such wigs commonly have a great number of strands of human hair or artificial hair implanted in a wig base, which is formed of a net-like article obtained by weaving fibers into a net or grid form, or of an artificial scalp formed of synthetic resin. Implanting the hair fibers into the net has long been performed by knotting the hair fibers to the net in the case of using the net-like article, and inserting the hair fibers through the base where they are fixed by use of a synthetic resin adhesive agent in the case of using the synthetic resin artificial scalp.

However, wearing such a wig results in base tips of the hair fibers protruding from a back side of the wig base coming into contact with the human scalp, thereby causing pain. Particularly, wearing such a wig for long periods of time subjects the wearer to considerable discomfort.

Further, base tips of the hair fibers protruding from the rear side of the wig base give an overall rough feeling, so the wearer does not have a sensation of a fully sufficiently good fit, and accordingly, experiences unease in that the wig can be easily dislodged.

There have been some wigs with protrusions on a wig base, such as that disclosed in Japanese Unexamined Patent Application Publication No. 3-76804 wherein permanent magnets are arrayed on a rear side of the wig base, to which hair fibers have been implanted, for a purpose of encouraging growth of hair, or that disclosed in Japanese Examined Utility Model Registration Application Publication No. 2-78522 wherein protrusions around 2 mm in thickness are arrayed on a rear side of a wig base, to which hair fibers have been implanted, for a purpose of creating a gap between the scalp and the wig at a time of wearing the wig, thereby allowing passage of air to prevent heat from collecting.

Also, there is a known arrangement wherein strands of hair material are implanted V-shaped into an artificial scalp face primarily formed of silicone resin, with hair root portions protruding from a scalp face side of a wig, with these protruding portions being glued to a cloth face, as disclosed in Japanese Examined Utility Model Registration Application Publication No. 5-27456.

SUMMARY OF THE INVENTION

It is an object of the present invention to provide a wig wherein effects of base tips of human hair or artificial hair strands implanted in a base at a time of wearing the wig are eliminated, thereby realizing a wig that produces no discomfort while it is worn, as well as maintaining a good fit for a wearer so the wig does not become dislocated.

More particularly, it is an object of the present invention to provide a wig wherein a great number of protrusions having elasticity are arrayed on a rear face of a wig base into which human hair or artificial hair is implanted.

To achieve these objects, according to a first aspect of the present invention, a wig comprises: a wig base to be worn on the head of a wearer, with human hair or artificial hair implanted into the base; and a plurality of protrusions formed of a silicone substance; wherein a plurality of rows of the protrusions are arrayed at predetermined intervals on a side of the wig base that is to face the scalp of the wearer. The protrusions may have a generally circular shape 5 to 15 mm in diameter, and have a thickness of 0.5 to 2.0 mm. Further, a plurality of rows of the protrusions provided on the base may be arrayed at intervals of 1.0 to 3.0 cm.

According to a second aspect of the present invention, in a method for fabricating a wig, a masking sheet having a great number of openings formed therein is applied to a side of a wig base that is to face the scalp of the wearer, a silicone adhesive agent is applied to the side of the wig base through the openings, one end of a tablet formed of a silicone substance which can be placed within the opening is adhered to the silicone adhesive agent, and further, silicone adhesive agent is applied to a surface of the tablet and dried, following which the masking sheet is removed, thereby providing a wig base having silicone protrusions fixed to the side thereof which is to face the scalp of the wearer.

The reason that silicone is used for the protrusions of the wig according to the present invention is that silicone has high chemical resistance and oil resistance, does not readily deteriorate due to oils or sweat secreted from the scalp of the wearer, or hair dressing or like substances, and has excellent resistance to heat and cold; meaning that a retaining force thereof due to excellent resilience and friction resistance thereof is well exhibited regardless of changes in external temperature or increased temperatures due to wearing of the wig. Also, silicone has a high level of elasticity even though this resin is not very hard; meaning that a sensation of wearing is natural to a user, and the wig does not readily shift position, i.e., the wig has a natural fit for the user. Moreover, silicone is hypoallergenic in nature, and there is practically no chance of adverse effects on the human body.

The protrusions according to the present invention formed of silicone are suitably of circular shapes in the range of 5 mm to 15 mm in diameter, having a thickness of 0.5 to 2.0 mm, but a diameter of 8 mm and a thickness of around 1.0 mm are particularly preferable. In the event that the diameter is 5 mm or smaller, an area of contact with the scalp is reduced; meaning that effects of the base tips of the human hair or artificial hair, implanted in the base, on the scalp cannot be sufficiently eliminated. Also, a retaining force of the wig deteriorates and displacement preventing effects deteriorate, which can be dealt with by increasing the number of protrusions substantially, but this makes work of attaching the protrusions troublesome. Also, in the event that the diameter is 15 mm or greater, effects of the base tips of the human hair or artificial hair, implanted in the base, on the scalp can be sufficiently eliminated and also a retaining force of the wig improves, so prevention or dislocation and a fit improves; however, an area of contact between the silicone protrusions and the scalp or hair is too great, and can lead to problems of heat collecting at the scalp. This can also lead to sensations of stickiness or itchiness, resulting in different discomforts. Furthermore, the wig becomes overall thicker.

Further, in the event that the thickness of the protrusions is 0.5 mm or less, the back face of the wig in general comes into contact with the scalp, so that effects of providing the protrusions cannot be exhibited, discomfort of the scalp is not solved, and displacement prevention effects cannot be realized either. On the other hand, with a thickness of at least 2 mm, a gap between the scalp and the wig is so great that the wig is in effect riding up away from the scalp, and accordingly the wig is readily displaced at a time of wearing the wig, and also the wearer does not experience a good fit of the wig.

A silicone adhesive agent is used to glue these silicone tablets to the wig base. Not only does this improve adhesion with the silicone tablets, but the silicone adhesive agent is soft even after application and hardening, and also is elastic in nature; meaning that hardening of the wig in its entirety, following provision of the protrusions, can be avoided. The rows of protrusions are preferably spaced by 1.0 to 3.0 cm, and particularly, 2.0 cm intervals between the rows is desirable. Smaller intervals can lead to sensations of heat and itchiness, resulting in different discomfort, and the protrusions change a form of the wig. Intervals of at least 3.0 cm result in portions of the wig base between the rows of protrusions sagging and coming into contact with the scalp, so that effects of the base tips of the human hair or artificial hair, implanted in the base, on the scalp is lost. Further, local displacement occurs at portions exhibiting weak contact with the scalp, which can cause deformation of the wig while wearing the wig, while portions exhibiting greater contact with the scalp can pull on the scalp or hair, thereby causing pain.

At a time of arraying the silicone protrusions according to the present invention, taken into consideration is the fact that a shape of the human head is far from a perfect circle, and is quite irregular in form. Accordingly, a methodical array will result in portions where the protrusions come into sufficient contact with the scalp, portions where contact between the scalp and protrusions is insufficient, and portions where there is no contact at all between the scalp and protrusions, thereby leading to discomfort in wearing of the wig. Also, during prolonged periods of wearing the wig, the portions where the protrusions are attached can rise up in ridges, thereby deforming the wig.

Accordingly, rather than arraying the rows of protrusions following a pattern, a fabrication method wherein the rows of protrusions are arrayed randomly at desired portions or over an entire area of contact with the scalp at a time of wearing the wig is desirable.

The wig according to the present invention shown in the drawings has a great number of the silicone protrusions which have elasticity arrayed at a side of the base which comes into contact with the scalp, so as to create a sufficient gap between the base of the wig and the scalp so as to prevent any base tips of the human hair or artificial hair, protruding from the rear side of the base due to being implanted therein, from coming into contact with the scalp of the wearer. Consequently, discomfort of the scalp is reduced as compared to conventional articles. Moreover, this provides a great retaining force so that the wig is not readily displaced, and a good fit is maintained even when wearing the wig for prolonged periods of time.

DETAILED DESCRIPTION OF THE PREFERRED EMBODIMENTS

An embodiment of the present invention will now be described with reference to the drawings.

A wig according to the present invention is fabricated by a masking sheet, having a great number of openings formed therein, being applied to a side of a wig base which is to face the scalp of a wearer when the wig is worn by the wearer, a silicone adhesive agent being applied to portions of the wig base exposed through the openings, one end of a tablet at most 1 mm in thickness formed of a silicone substance which can be placed within the opening being adhered thereto, and further, silicone adhesive agent being applied to a surface of the tablet and dried, following which the masking sheet is removed, thereby fixing silicone protrusions to a side of the wig base which is to face the scalp of the wearer.

The reason for a masking sheet having a great number of openings formed therein for fixing silicone tablets is because positions for attaching the silicone tablets to the base can be easily determined without soiling the base as compared to other methods, and also excessive adhesive agent can be dealt with thereby, so that an appearance of a completed wig is not diminished in any way. Further, there is no irregularity in a fixing force of the adhesive agent due to difference in an amount of the adhesive agent from one silicone protrusion to another, and accordingly a stable fixing force can be obtained.

Also, applying silicone adhesive agent to the surface of the silicone tablets improves the fixing force by covering an entire silicone tablet with the adhesive agent as compared to fixing one end portion of the silicone tablet to the wig base. This further improves a retaining force of the wig at a time of wearing, thereby making displacement less likely to occur, and providing a good fit.

Figure 1A:
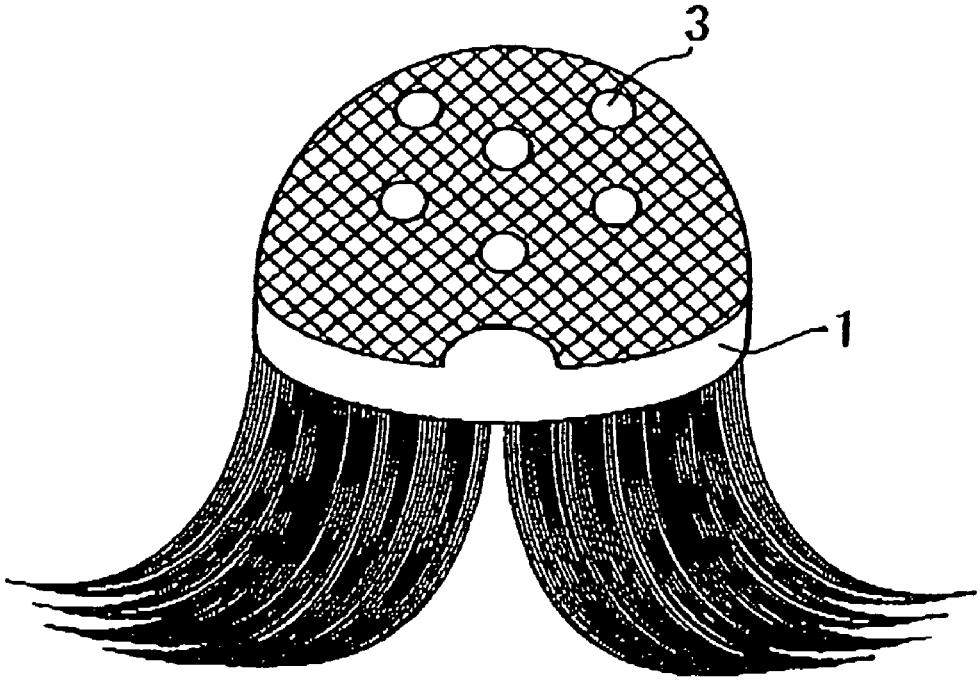
FIGS. 1A and 1B are views illustrating an overall configuration of a first embodiment, showing a rear face of a wig base according to the present invention.
Figure 1B:
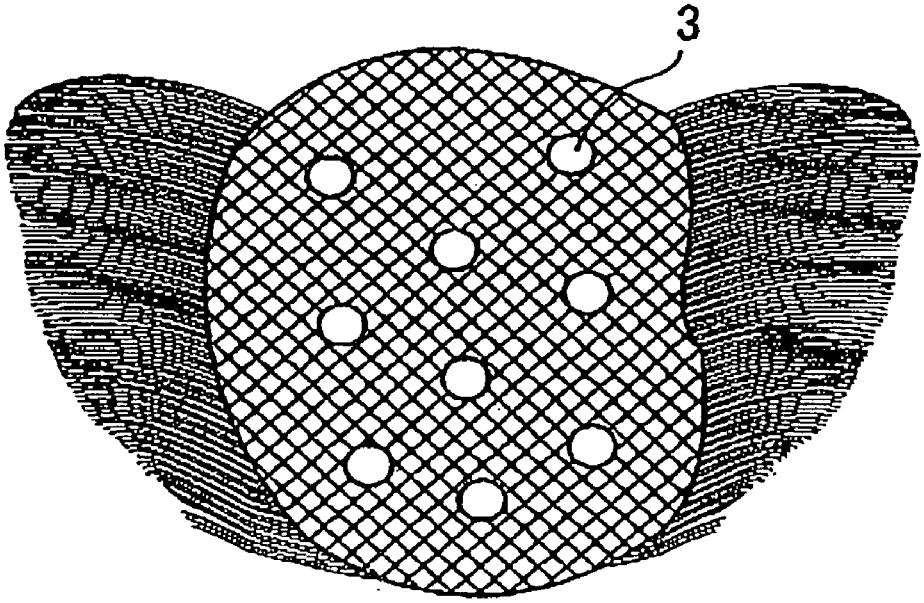

With reference to FIGS. 1A and 1B, base 1 of the wig according to the present invention has an edge portion thereof formed in a band-like manner, with an inner side of the edge portion formed of a membrane or net of a material such as medical artificial skin, polyurethane, straightchain aliphatic polyamide, polyester, or like synthetic resin material. A shape of the base 1 is a half-sphere curved according to a shape of a head. The base 1 may also be formed of a shape-memory resin. Around 0.1 to 0.3 mm is suitable for a thickness of the base 1 itself.

Human hair or artificial hair strands are implanted into the base 1, with base tips 4 of implanted portions protruding from a protrusion attaching side of the base 1 such that the hair or hair strands appear to grow from the side of the base that is face the scalp of a wearer.

A masking sheet 2 having openings of around 10 mm in diameter is applied to an attaching face (adhesion face) 1*a* of the base 1.

Figure 2:
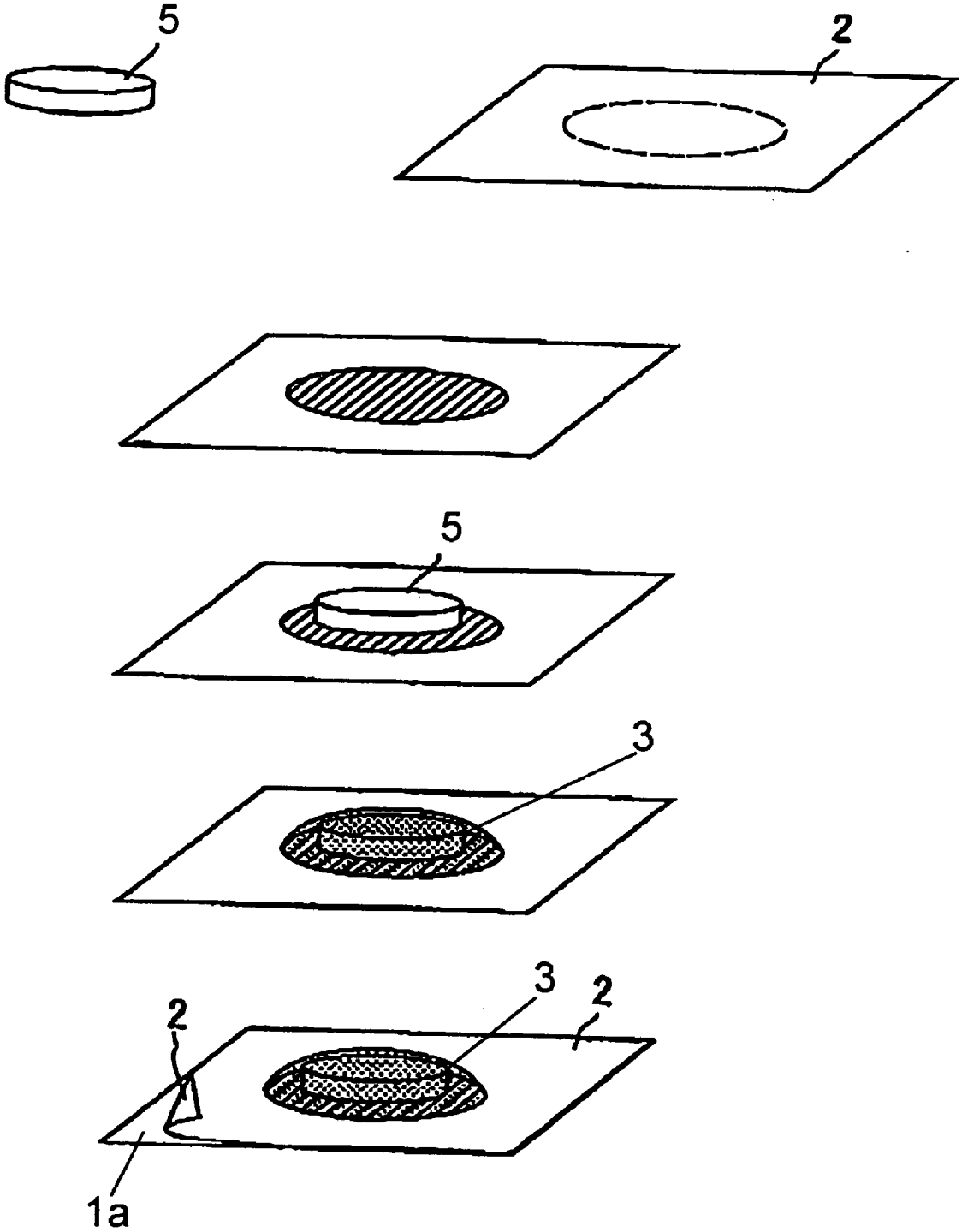
FIG. 2 is an explanatory diagram illustrating fabrication processing of the wig according to the present invention.

With reference to FIG. 2., a silicon adhesive agent is poured or otherwise applied onto portions of attaching face 1*a* exposed through the openings of the masking sheet 2, and silicone tablets 5 having a diameter of 8 mm and a thickness of 1 mm are glued to these exposed portions via the adhesive agent. Silicone adhesive agent is then thinly applied from above these glued tablets 5 so as to cover the tablets and adhere to the exposed portions of attaching face 1*a*. This adhesive agent is dried, and the masking sheet 2 is then removed.

Thus, multiple silicone tablet protrusions 3 are arrayed on a rear face of the base 1. The hair or hair strands can be implanted into base 1 prior to forming the protrusions, or the protrusions can be formed prior to implanting the hair or hair strands into the base.

Figure 3:
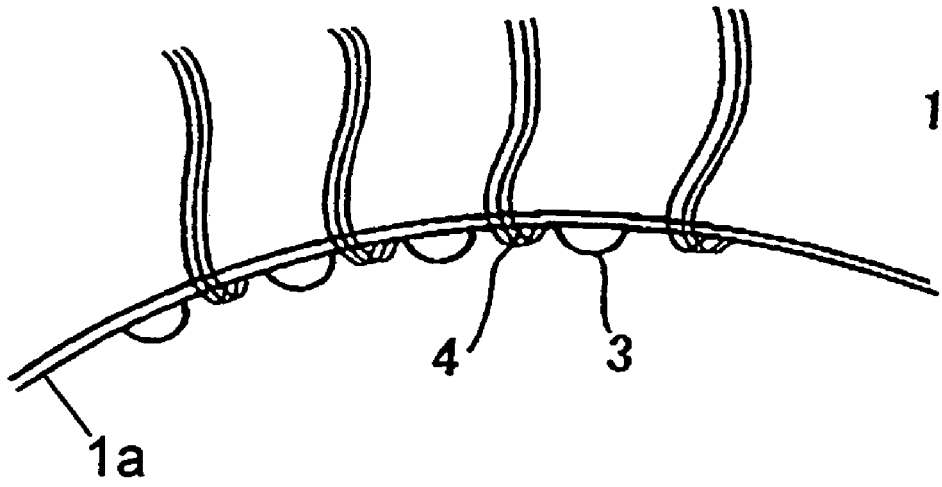
FIG. 3 is a partially enlarged drawing of the wig according to the present invention.

As shown in FIG. 3, a great number of silicone tablet protrusions 3 protrude from the rear face of the base 1, so the base tips 4 of the implanted human hair or artificial hair do not come into contact with the scalp of the wearer.

In the event that the wig according to the present invention is worn on the head, the base tips 4 of the implanted human hair or artificial hair do not come into contact with the scalp of the wearer since the silicone protrusions on the rear face protrude farther, and accordingly, sensation at the scalp is better, there is no discomfort resulting from prolonged use or repeated use, and there is a good fit between the silicone protrusions and the scalp.

According to the wig of the present invention, the base tips of the implanted human hair or artificial hair do not come into contact with the scalp of the wearer, and accordingly, a rough sensation is eliminated by provision of the silicone protrusions. Accordingly, a wearer can comfortably wear the wig for prolonged periods of time.

What is claimed is:

1. A method of making a wig, comprising:

forming rows of silicone protrusions, spaced at predetermined intervals, on a side of a wig base that is to face the scalp of a wearer when said wig base is worn on the head of a wearer, by (i) providing on a base material a masking sheet having openings such that portions of said base material are exposed through said openings, (ii) applying a silicone adhesive to the exposed portions of said base material, (iii) positioning silicone members on said silicone adhesive such that said silicone members become bonded to said base material via said silicone adhesive, (iv) covering said silicone members with a silicone adhesive, and then (v) removing said masking sheet from said base material; and implanting human hair or artificial hair into said wig base such that said human hair or artificial hair extends from said wig base.

2. The method according to claim 1, wherein forming rows of silicone protrusions on a side of a wig base that is to face the scalp of a wearer comprises forming silicone protrusions that are each generally circular in shape, with each having a diameter within a range of from 5 mm to 15 mm and a thickness within a range of from 0.5 mm to 2.0 mm.

3. The method according to claim 2, wherein forming said rows of silicone protrusions on said side of said wig base that is to face the scalp of the wearer comprises forming said rows of silicone protrusions such that adjacent ones of said rows of silicone protrusions are spaced from one another by a distance within a range of from 1.0 cm to 3.0 cm.

4. The method according to claim 1, wherein implanting human hair or artificial hair into said wig base comprises implanting said human hair or artificial hair into said wig base such that said human hair or artificial hair appears to grow from said side of said wig base that is to face the scalp of the wearer.

5. The method according to claim 4, wherein forming rows of silicone protrusions on a side of a wig base that is to face the scalp of a wearer comprises forming silicone protrusions that are each generally circular in shape, with each having a diameter within a range of from 5 mm to 15 mm and a thickness within a range of from 0.5 mm to 2.0 mm.

6. The method according to claim 5, wherein forming said rows of silicone protrusions on said side of said wig base that is to face the scalp of the wearer comprises forming said rows of silicone protrusions such that adjacent ones of said rows of silicone protrusions are spaced from one another by a distance within a range of from 1.0 cm to 3.0 cm.

7. The method according to claim 1, wherein forming said rows of silicone protrusions on said side of said wig base that is to face the scalp of the wearer comprises forming said rows of silicone protrusions such that adjacent ones of said rows of silicone protrusions are spaced from one another by a distance within a range of from 1.0 cm to 3.0 cm.

8. The method according to claim 7, wherein implanting human hair or artificial hair into said wig base comprises implanting said human hair or artificial hair into said wig base such that said human hair or artificial hair appears to grow from said side of said wig base that is to face the scalp of the wearer.

9. A method of making a wig, comprising:

providing on a base material a masking sheet having rows of openings spaced at predetermined intervals, such that portions of said base material are exposed through said openings;

applying a silicone adhesive to the exposed portions of said base material;

positioning silicone members on said silicone adhesive such that said silicone members become bonded to said base material via said silicone adhesive;

covering said silicone members with a silicone adhesive; then removing said masking sheet from said base material, thereby providing a wig base having rows of silicone protrusions, spaced at predetermined intervals, on a side of said wig base that is to face the scalp of a wearer when said wig base is worn on the head of the wearer; and then attaching hair to said wig base.

10. The method according to claim 9, wherein providing a wig base having rows of silicone protrusions on a side of said wig base that is to face the scalp of a wearer comprises providing a wig base having silicone protrusions that are each generally circular in shape, with each having a diameter within a range of from 5 mm to 15 mm and a thickness within a range of from 0.5 mm to 2.0 mm.

11. The method according to claim 10, wherein said rows of silicone protrusions are spaced from one another by a distance within a range of from 1.0 cm to 3.0 cm.

12. The method according to claim 11, wherein attaching hair to said wig base comprises implanting said hair into said wig base such that said hair appears to grow from said side of said wig base that is to face the scalp of the wearer.

13. The method according to claim 10, wherein attaching hair to said wig base comprises implanting said hair into said wig base such that said hair appears to grow from said side of said wig base that is to face the scalp of the wearer.

14. The method according to claim 9, wherein providing a wig base having rows of silicone protrusions on a side of said wig base that is to face the scalp of a wearer comprises providing a wig base having said rows of silicone protrusions such that adjacent ones of said rows of silicone protrusions are spaced from one another by a distance within a range of from 1.0 cm to 3.0 cm.

15. The method according to claim 14, wherein attaching hair to said wig base comprises implanting said hair into said wig base such that said hair appears to grow from said side of said wig base that is to face the scalp of the wearer.

16. The method according to claim 9, wherein attaching hair to said wig base comprises implanting said hair into said wig base such that said hair appears to grow from said side of said wig base that is to face the scalp of the wearer.

17. A method of making a wig base, comprising:

providing on a base material a masking sheet having rows of openings spaced at predetermined intervals, such that portions of said base material are exposed through said openings;

applying a silicone adhesive to the exposed portions of said base material;

positioning silicone members on said silicone adhesive such that said silicone members become bonded to said base material via said silicone adhesive;

covering said silicone members with a silicone adhesive; and then removing said masking sheet from said base material, thereby providing rows of silicone protrusions, spaced at predetermined intervals, on a side of said base material.

18. The method according to claim 17, wherein providing rows of silicone protrusions on a side of said base material comprises providing silicone protrusions that are each generally circular in shape, with each having a diameter within a range of from 5 mm to 15 mm and a thickness within a range of from 0.5 mm to 2.0 mm.

19. The method according to claim 18, wherein said rows of silicone protrusions are spaced from one another by a distance within a range of from 1.0 cm to 3.0 cm.

20. The method according to claim 17, wherein providing rows of silicone protrusions on a side of said base material comprises providing said rows of silicone protrusions such that adjacent ones of said rows of silicone protrusions are spaced from one another by a distance within a range of from 1.0 cm to 3.0 cm.

* * * * *